US005283410A

United States Patent [19]

Kim

[11] Patent Number: 5,283,410

[45] Date of Patent: Feb. 1, 1994

[54] METHOD AND APPARATUS FOR AUTOMATIC COOKING IN A MICROWAVE OVEN

[75] Inventor: Ji W. Kim, Seoul, Rep. of Korea

[73] Assignee: Goldstar Co., Ltd., Seoul, Rep. of Korea

[21] Appl. No.: 809,162

[22] Filed: Dec. 18, 1991

[30] Foreign Application Priority Data

Dec. 18, 1990 [KR] Rep. of Korea ..... 20961/1990

[51] Int. Cl.[5] ..... H05B 6/68

[52] U.S. Cl. ..... 219/704; 219/708; 219/710; 364/148; 364/503; 177/145

[58] Field of Search ..... 219/10.55 B, 10.55 F, 219/10.55 M, 518; 177/145, 4, DIG. 9; 364/148, 503, 504

[56] References Cited

U.S. PATENT DOCUMENTS

| | | | |
|---|---|---|---|
| 3,799,281 | 3/1974 | Wernitz | 177/DIG. 9 |
| 4,591,684 | 5/1986 | Tanabe et al. | 219/10.55 B |
| 4,593,167 | 6/1986 | Nilssen | 219/10.55 B |
| 4,650,970 | 3/1987 | Ohouchi | 219/10.55 R |
| 4,696,358 | 9/1987 | Doerman et al. | 177/145 |
| 4,713,528 | 12/1987 | Hirata | 219/10.55 B |
| 4,831,239 | 5/1989 | Ueda | 219/10.55 B |
| 4,910,684 | 3/1990 | Ostergaard et al. | 364/148 |
| 4,970,359 | 11/1990 | Oh | 219/10.55 M |

FOREIGN PATENT DOCUMENTS

| | | |
|---|---|---|
| 0106898 | 5/1984 | European Pat. Off. . |
| 3205124 | 8/1983 | Fed. Rep. of Germany . |
| 3236952 | 4/1984 | Fed. Rep. of Germany . |
| 2-044126 | 2/1990 | Japan . |
| 2211001 | 6/1989 | United Kingdom . |

*Primary Examiner*—Bruce A. Reynolds
*Assistant Examiner*—Tu Hoang

[57] ABSTRACT

Method and apparatus for automatic cooking in a microwave oven capable of an automatic cooking operation even in case of consecutive cooking by discriminating whether the operation mode is an initial operation mode or a consecutive operation mode by receiving an inflow air temperature and an outflow air temperature in the initial operating stage, selecting the initial operation mode or the consecutive operation mode, executing a cooking operation by driving a magnetron and a cooling fan after calculating an arbitrary initial heating time, calculating a difference between the current outflow air temperature and the previous outflow air temperature when the initial heating time has been elapsed, giving a fuzzy membership function and rule for the selected initial operation mode or the consecutive operation mode by the outflow air temperature difference and a weight conversion value, calculating a cooking time by executing a fuzzy operation, calculating an additional heating time by subtracting the initial heating time from the calculated cooking time, and executing continuously the cooking operation for the additional heating time.

12 Claims, 14 Drawing Sheets

FIG. 14 (A)

| WEIGHT / ΔT2 = Tb2 - Tb1 | PS | PM | P |
|---|---|---|---|
| P S | PS1 | PS1 | PS2 |
| PM | PS2 | PM1 | PM2 |
| PL | PM2 | PL1 | PL2 |

FIG. 14 (B)

| WEIGHT / ΔT3 = Tb3 - Tb2 | PS | PM | PB |
|---|---|---|---|
| P S | PS1 | PS1 | PS2 |
| P M | PS2 | PM1 | PM2 |
| PL | PM1 | PM2 | PL1 |

METHOD AND APPARATUS FOR AUTOMATIC COOKING IN A MICROWAVE OVEN

BACKGROUND OF THE INVENTION

The present inventin relates to a method and an apparatus for automatic cooking in a microwave oven which is capable of executing automatic cooking in an optimal state by detecting an inflow air temperature, an outflow air temperature, and a weight of food to be cooked and calculating a cooking time using the detected signals relating to the inflow and outflow air temperatures and the weight of food in a fuzzy control even in the case of a continuously using the microwave oven.

Various types of cooking methods and apparatuses for use in a microwave oven are well known in the art. One conventional microwave oven is illustrated in FIG. 1. As shown in FIG. 1, the conventional microwave oven comprises a microcomputer 1 for controlling the operation of the whole system, a magnetron driving section 2 for supplying a magnetron driving power upon the control of the microcomputer 1, a magnetron 3 for generating a microwave by being driven by the magnetron driving power of the magnetron driving section 2, a heating chamber 11 for heating the food positioned on a glass tray with the microwave generated at the magnetron 3, a cooling fan motor 4 which is actuated upon the control of the microcomputer 1, a cooling fan 5 for blowing air in the heating chamber 11 by being actuated by the cooling fan motor 4, an outflow air temperature sensor 6, mounted on an outlet 12 of the heating chamber 11, for detecting the temperature of the air which is discharged through the outlet 12, an analog/digital coverter 7 for converting the air temperature signal detected at the outflow air temperature sensor 6 into a digital signal and applying the converted digital signal to the microcomputer 1, a turntable motor 9, mounted below the heating chamber 11, for rotating the glass tray 10 upon the control of the microcomputer 1, and a weight sensing section 8, disposed below the heating chamber 11, for detecting the weight of food and applying the detected weight signal to the microcomputer 1.

With reference to FIGS. 2 and 3, the operation of the conventional microwave oven is described hereinbelow.

Upon pressing a button for automatic cooking in a state that the food to be cooked is positioned on the glass tray 10 within the heating chamber 11, the microcomputer 1 executes a first stage heating operation for a predetermined time(t), as shown in FIGS. 2 and 3, and actuates the cooking fan 5 to blow air into the heating chamber 11 so that the air temperature of the heating chamber 11 can be made uniform. After a predetermined time T1 has elapsed, the microcomputer 1 carries out a temperature, increment setting operation. That is, the current temperature T1 of the air discharged through the outlet 12 of the heating chamber 11 is detected by the outflow air temperature sensor 6 and converted into a digital signal at the analog/digital converter 7. The digital signal of the current temperature t1 is applied to the microcomputer 1 so that the microcomputer 1 can calculate the temperature increment therefrom. When the temperature increment is set, the magnetron 3 is continuously actuated by the magnetron actuating section 2. As time passes, the food positioned on the glass tray 10 within the heating chamber 11 is heated by the microwave and thus the temperature of the air discharged through the outlet 12 becomes high. The temperature of the discharged air is detected at the outflow air temperature sensor 6 and converted into a digital signal by the analog/digital converter 7 and then applied to the microcomputer 1. Accordingly, the microcomputer 1 executes a first stage heating operation until the temperature increment T2-T1 of the outflow air rises to the temperature increment $\Delta T$ which has already been established.

In this state, when the temperature increment of the outflow air, i.e., the temperature increment T2-T1 obtained by subtracting the initial temperature T1 from the current temperature T2, arrives the preestablished temperature increment $\Delta T$, the microcomputer 1 finishes the first stage heating operation and calculates a second stage additional heating time t3 to execute a second stage heating operation. That is, the second stage heating time t3 is calculated by multiplying a predetermined value $\alpha$, which is established in accordance with the type of food, by the first stage heating time t2, and the magnetron 3 is continuously actuated for the second stage heating time t3 to heat the food. When the second stage heating time t3 is complete, the microcomputer 1 stops the operation of the magnetron 3 and the cooling fan 5, thereby completing the cooking.

However, in such an automatic cooking method for use in the conventional microwave oven, there has been a disadvantage in that it is impossible to correctly execute an automatic cooking operation since the temperature increment $\Delta T$ becomes dull more than that in case of cooking the previous food when another food is cooked immediately after the previous food has been cooked. That is, when the cooking operation is finished in a state that the outflow air temperature, detected at the outflow air temperature sensor 6, is raised to a predetermined temperature T3, as shown in FIG. 3B, after cooking one type of food, the outflow air temperature T drops down gradually. At this moment, when starting the cooking operation again at the temperature range T4–T8 which is higher than the initial temperature T1, the temperature increment rate becomes low, as shown in FIG. 2C, so that the first stage heating time and the second stage heating time are set too long. Accordingly, the next food to be cooked in the consecutive cooking operation may be excessively heated so that an automatic cooking operation can not correctly be executed. As a result, a non-operation period for about 10 to 30 minutes is required before executing automatic cooking again.

SUMMARY OF THE INVENTION

Accordingly it is an object of the present invention to provide a method and apparatus for automatic cooking in a microwave oven which is capable of executing an automatic cooking operation by discriminating whether it is a consecutive cooking or an initial cooking and calculating the cooking time for food in accordance with the discrimination result.

Another object of the present invention is to provide a method for automatic cooking in a microwave oven which is capable of executing an automatic cooking operation by calculating the cooking time for food in accordance with the weight of the food to be cooked.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to an automatic cooking apparatus for use in a microwave oven which includes outflow and inflow air temperature sensors for detecting the temperature of outflow air and inflow air, outflow and inflow air temperature sensing circuits for converting the signal detected at the outflow and inflow air temperature sensore into an electrical signal, a weight sensor for detecting the weight of the food positioned within a heating chamber, a weight sensing circuit for converting the signal detected at the weight sensor into an electrical signal, an analog/digital converter for converting the output signals from the outflow and inflow air temperature sensing circuits and the weight sensing circuit into digital signals, respectively, a fuzzy controller for storing the output signal from the analog/digital converter to a data RAM and calculating the cooking time by executing a fuzzy operation in response to a program of a program ROM, and a magnetron driving section for controlling the operation of a magnetron upon the control of the fuzzy controller. Also, the present invention relates to an automatic cooking method for use in a microwave oven which includes the steps of detecting the temperature of air which flows in the heating chamber and the temperature of air which flows out of the heating chamber, discriminating whether it is an initial operation mode or a consecutive operation mode by receiving the inflow air temperature and outflow air temperature at the fuzzy controller and selecting the initial operation mode or the consecutive operation mode in response to the discrimination result, carrying out a cooking operation by driving the magnetron and the cooking fan for a predetermined initial heating time, calculating an outflow air temperature difference when the initial heating time has been elapsed, giving a fuzzy membership function and rule for the selected initial operation mode or the consecutive operation mode in response to the outflow air temperature difference and a weight conversion value, calculating a cooking time by executing a fuzzy operation, obtaining an additional heating time by subtracting the initial heating time from the calculated heating time, and executing the cooking operation continuously for the additional heating time.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 3A to 3C are graphs showing the temperature change with respect to the time in accordance with the operation of the microwave oven of FIG. 1, in which;

FIG. 3A is a graph showing the temperature increment rate in accordance with the operation of the microwave oven;

FIG. 3B is a graph showing the temperature change of an intial operation mode; and FIG. 3C is a graph showing the temperature change of a consecutive operation mode;

FIGS. 14A and 14B are explanatory views showing a fuzzy rule table of a fuzzy controller of FIG. 4, in which;

FIG. 14A is a view showing a fuzzy rule table of an initial operation cooking mode; and FIG. 14B is a view showing a fuzzy rule table of a consecutive operation cooking mode;

FIGS. 15A to 15C are explanatory views showing examples for giving a fuzzy membership function with respect to the weight according to the present invention, in which;

FIG. 15A is a graph showing a case that the weight is a small value (PS);

FIG. 15B is a graph showing a case that the weight is a middle value (PM); and FIG. 15C is a graph showing a case that the weight is a big value (PB);

FIGS. 16A to 16C are explanatory views showing examples for giving the fuzzy membership function with respect to the outflow air temperature difference, in which;

FIG. 16A is a graph showing a case that the outflow air temperature difference is a small value (PS);

FIG. 16B is a graph showing a case that the outflow air temperature difference is a middle value (PM); and FIG. 16C is a graph showing a case that the outflow air temperature difference is a large value (PL); and FIGS. 17A to 17E are explanatory views showing examples for giving the fuzzy membership function with respect to the cooking time according to the present invention, in which;

FIG. 17A is a graph showing a case that the cooking time is a first small value (PSi);

FIG. 17B is a graph showing a case that the cooking time is a second small value (PS2);

FIG. 17C is a graph showing a case that the cooking time is a first middle value (PM1);

FIG. 17D is a graph showing a case that the cooking time is a second middle value (PM2); and FIG. 17E is a graph showing a case that the cooking time is a large value (PL1).

DESCRIPTION OF THE PREFERRED EMBODIMENTS

Figure 1:
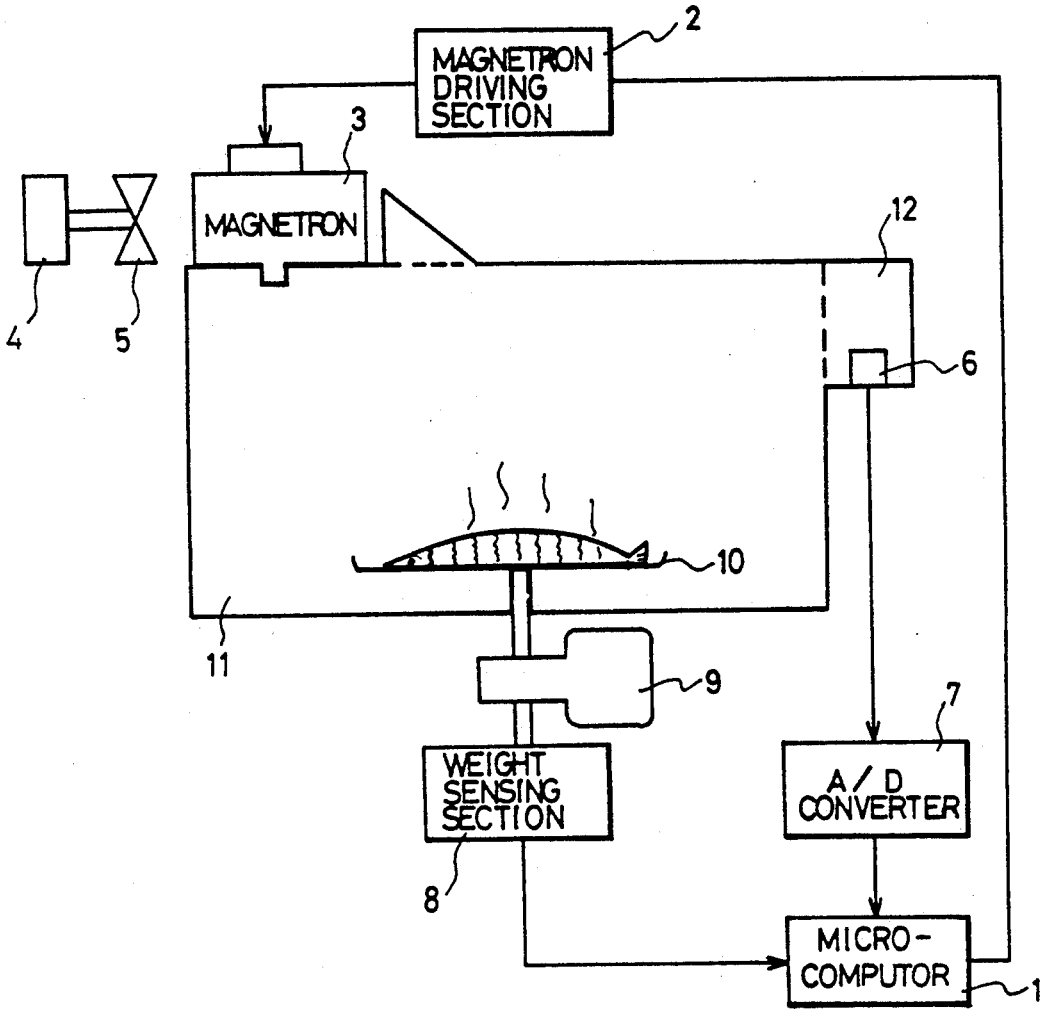
FIG. 1 PRIOR ART
FIG. 1 is a block diagram of a conventional microwave oven.
Figure 2:
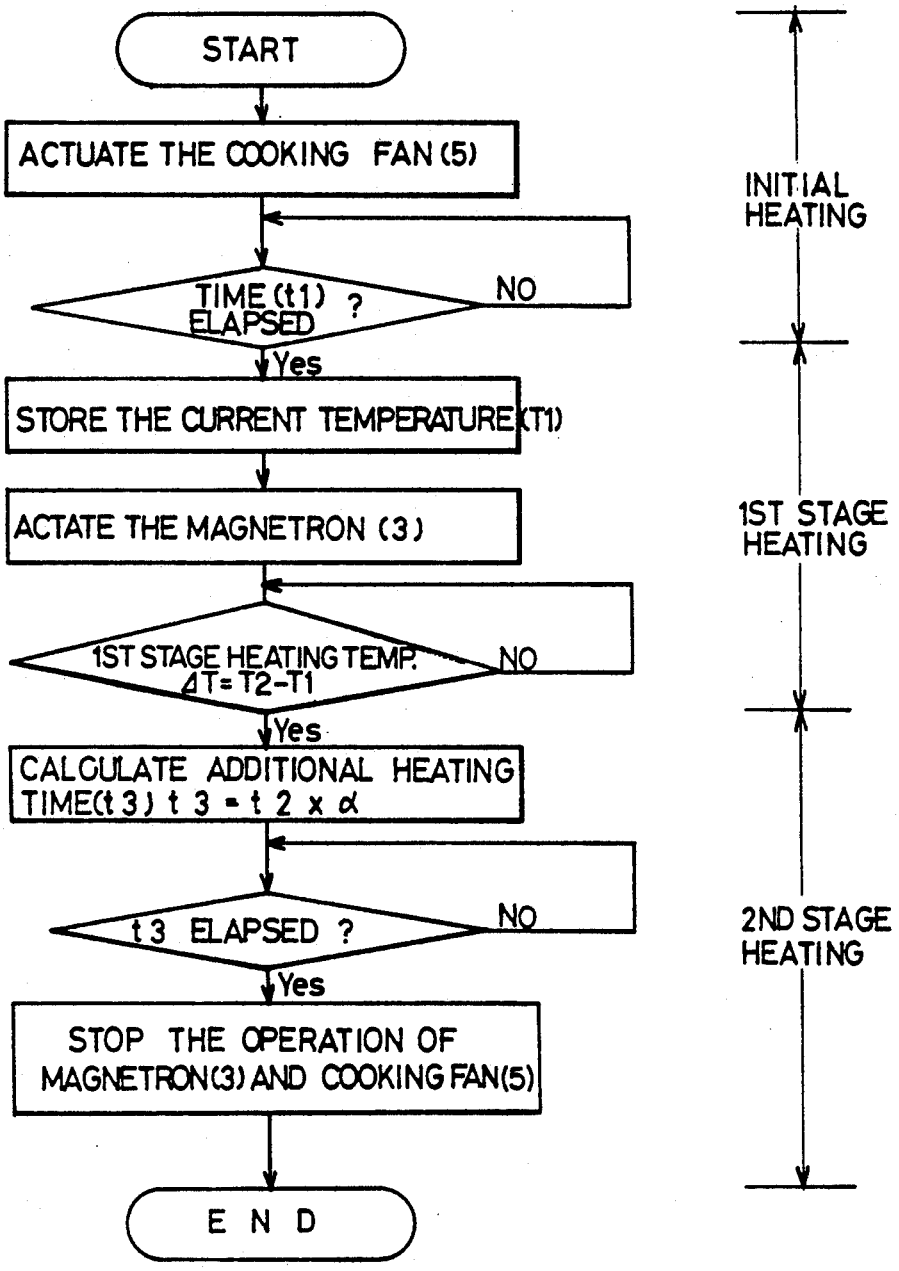
FIG. 2 PRIOR ART
FIG. 2 is a flowchart showing the operation of the microwave oven of FIG. 1.
Figure 3A:
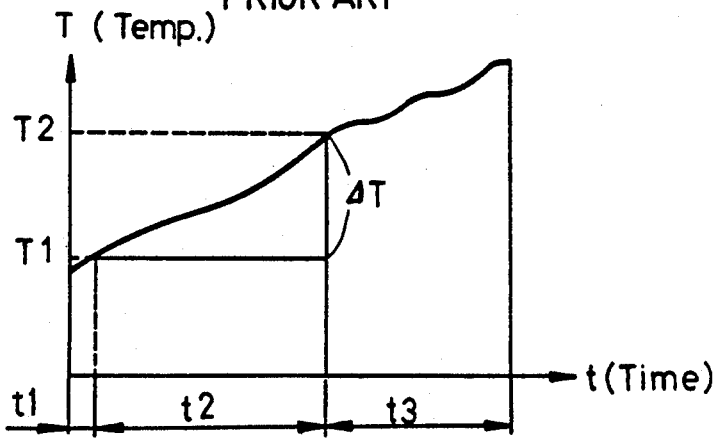
FIG. 3(A) PRIOR ART
Figure 3B:
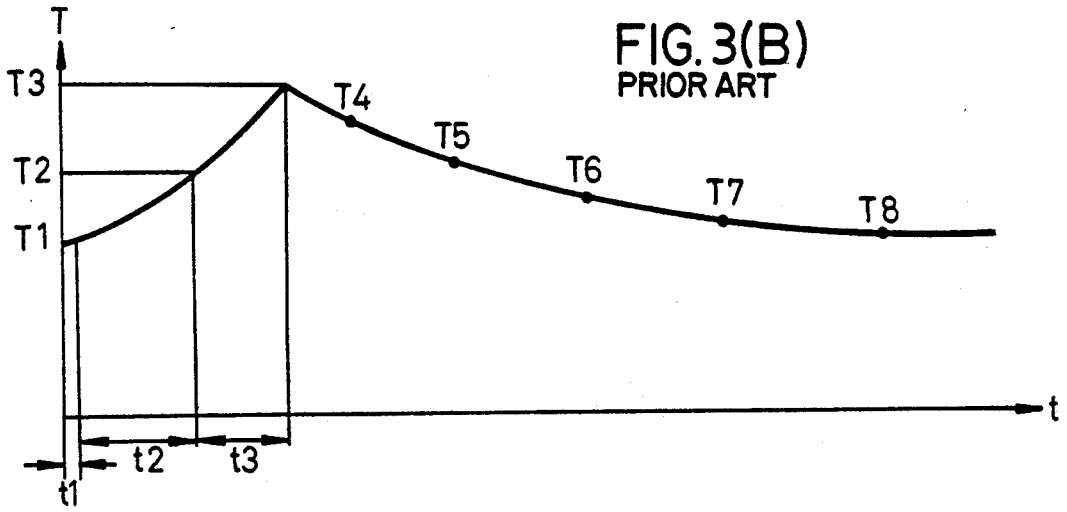
FIG. 3(B) PRIOR ART
Figure 3C:
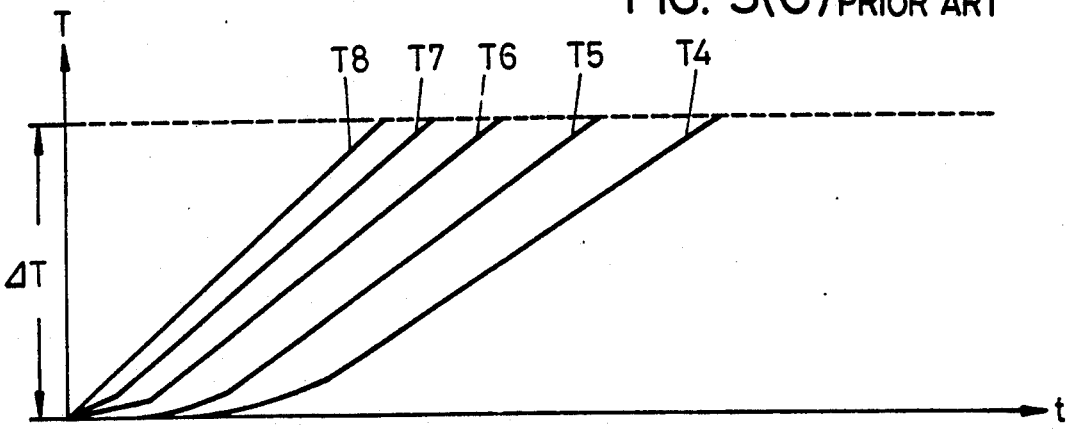
FIG. 3(C) PRIOR ART
Figure 4:
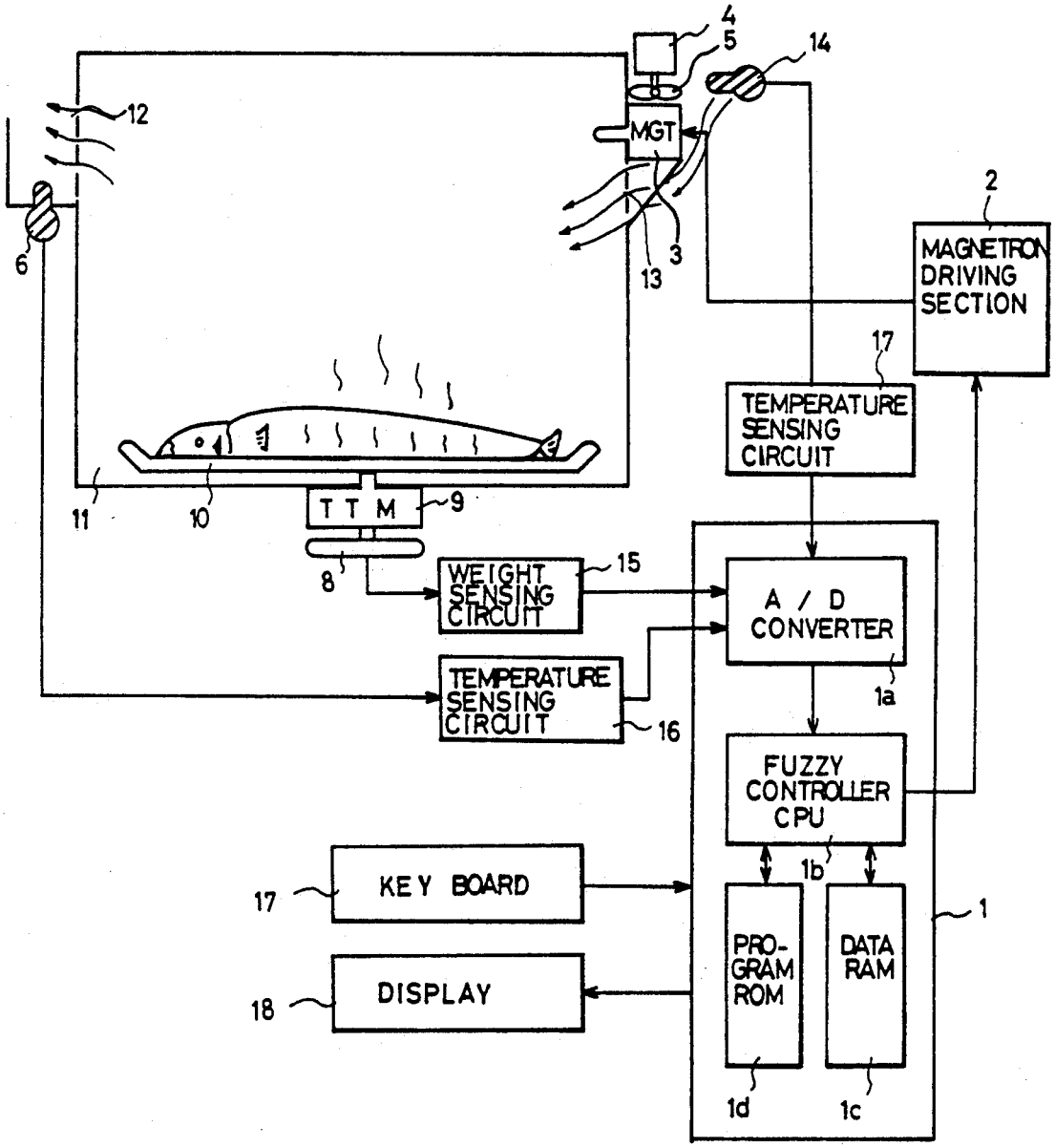
FIG. 4 is a block diagram of an automatic cooking apparatus of the present invention.

Referring now in detail to the drawings for the purpose of illustrating preferred embodiments of the present invention, the automatic cooking apparatus for use in a microwave oven as shown in FIG. 4, which comprises a keyboard 17 for selecting an automatic cooking and various types of cooking, a microcomputer 1 for controlling the whole operation of the system in response to the signal from the keyboard 17, a magnetron driving section 2 for supplying a magnetron driving power source upon the control of the microcomputer 1, a magnetron 3 for generating a microwave by the magnetron driving power source of the magnetron driving section 2, a heating chamber 11 for heating the food positioned on a glass tray 10 with the microwave from the magnetron 3, a cooling fan motor 4 which is driven upon the control of the microcomputer 1, a cooling fan 5, driven by the cooling fan motor 4, for blowing air into the heating chamber 11, an inflow air temperature sensor 14, mounted at an air inlet 13 of the heating chamber 11, for detecting the temperature of inflow air, an outflow air temperature sensor 6, mounted at an air outlet 12 of the heating chamber 11, for detecting the temperature of outflow air, temperature sensing circuits 17 and 16 each for detecting the detected signals of the inflow and outflow air temperature sensors 14 and 6 as electrical signals, a turntable 9, mounted below the heating chamber 11, for rotating the glass tray 10 upon the control of the microcomputer 1, a weight sensor 8, mounted below the heating chamber, for detecting the weight of the food to be cooked, a weight sensing circuit 15 for converting the weight signal detected at the weight sensor 8 into an electrical signal, an analog/digital converter 1*a* contained in the microcomputer 1 for converting the analog signal from the temperature sensing circuits 16 and 17 and the weight sensing circuit 15 into a digital signal, a fuzzy controller 16 for storing the inflow and outflow air temperature signals and weight signal, which are outputted from the analog/digital converter 1*a*, to a data RAM 1*d* and controlling the magnetron driving section 2 by executing an operation process by a program of a program ROM 1*c*, and a display section 18 for displaying various conditions of the microwave oven in response to the control signals of the microcomputer 1.

Figure 5:
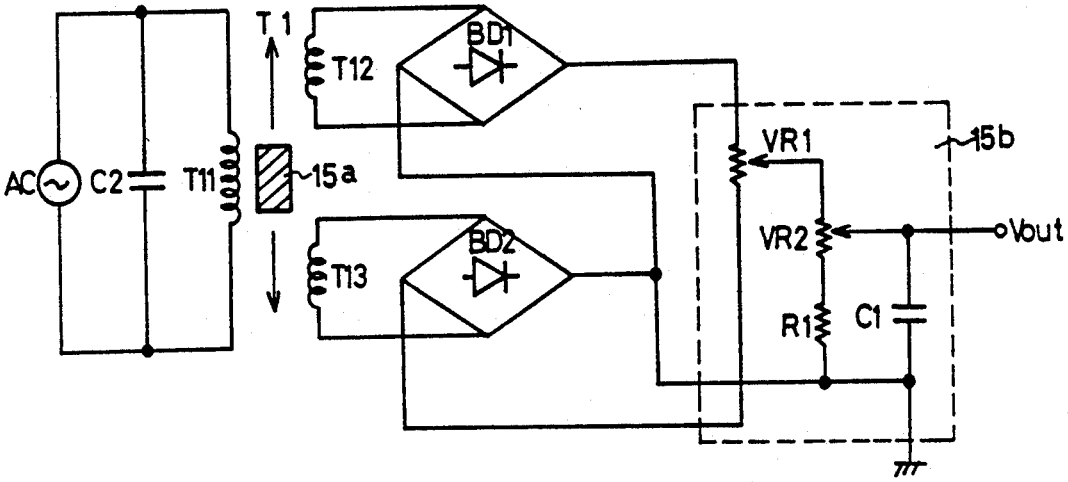
FIG. 5 is a detailed circuit diagram of a weight sensing circuit of FIG. 4.

Referring to FIG. 5, the weight sensing circuit 15 comprises a transformer T1 for receiving an alternating current of a predetermined frequency by its primary winding T11 and maintaining the alternating current with its secondary windings T12 and T13, a voltage inducer 15*a* for changing the inducing voltage of the secondary windings T12 and T13 by moving upwardly and downwardly between the primary winding T11 and the secondary windings T12 and T13 in response to the weight sensing signal of the weight sensor 8, bridge diodes BD1 and BD2 for rectifying the output voltage of the secondary windings T12 and T13, and a voltage detector 16*b* for detecting the output voltage difference between the bridge diodes BD1 and BD2 and outputting the detected signal through an output terminal Vout. The output voltage from the output terminal Vout is inputted to an analog/digital converter 1*a*.

Figure 6:
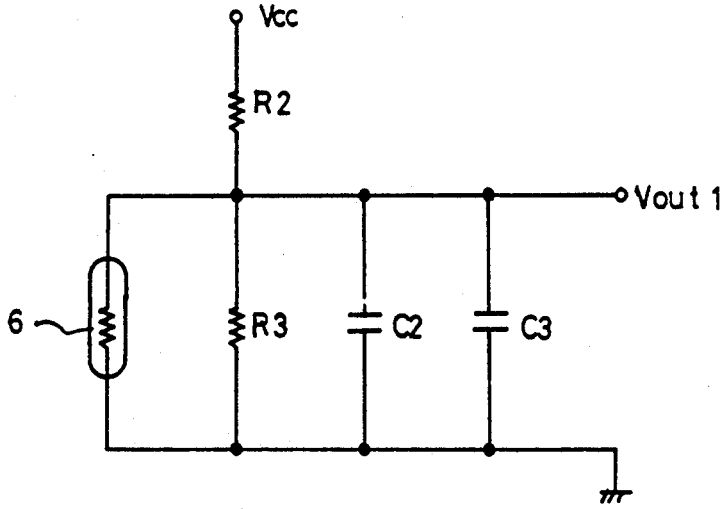
FIG. 6 is a detailed circuit diagram of a temperature sensing circuit of FIG. 4.

Referring to FIG. 6, the temperature sensing circuit 16 is constituted such that a power source terminal Vcc is connected through a resistor R2 to an outflow air temperature sensor 6 of which the resistance is varied in response to the outflow air temperature, and a resistor R3 and capacitors C2 and C3 are connected in series to the outflow air temperature sensor 6 so that the outflow air temperature is detected as a voltage. The detected voltage outputted from an output terminal Vout1 of the temperature sensing circuit 16 is inputted to the analog/digital converter 1*a*.

The temperature sensing circuit 17 is constituted in the same manner as in the temperature sensing circuit 16.

Figure 7:
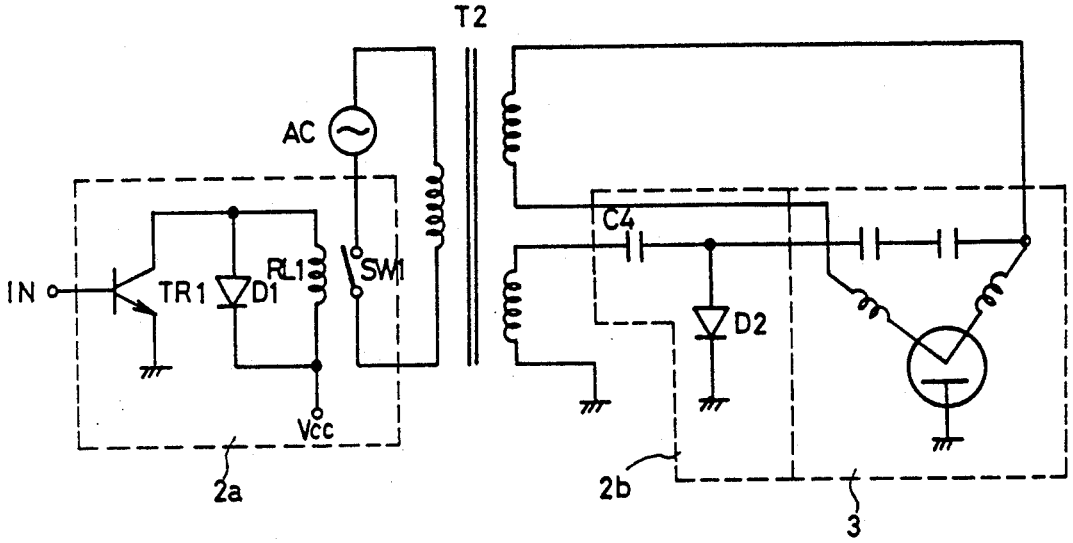
FIG. 7 is a detailed circuit diagram of a magnetron driving section of FIG. 4.
Figure 9:
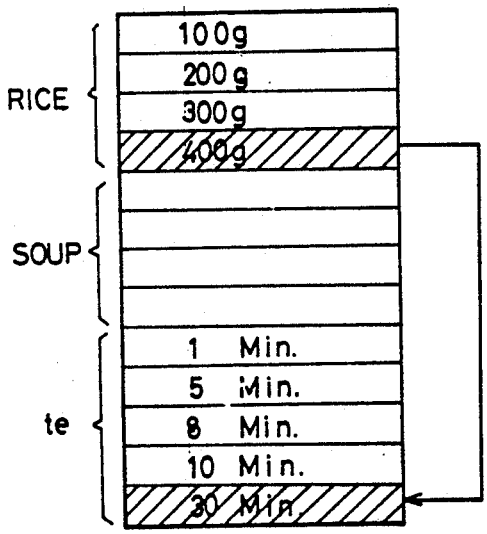
FIG. 9 is an explanatory view showing the data which are stored in a program ROM of FIG. 4.

Referring to FIG. 7, the magnetron driving section 2 and the magnetron 3 comprise a switching section 2*a* for switching an input of alternating current in response to turning on/off of a switch SW1 of a relay RL1 which is turned on/off by turning on/off of a transistor TR1 by a control signal outputted from a fuzzy controller 1*b* of the microcomputer 1, a transformer T2 for converting an alternating current into a high voltage when the alternating current is inputted by the switching operation of the switching section 2*a*, and a high voltage rectifier 2*b* for driving the magnetron 3 by rectifying the high voltage outputted from the transformer T2 by a capacitor C4 and a diode D2. In the drawing, reference character "IN" denotes an input terminal to which the control signal outputted from the fuzzy controller 1*b* is inputted.

The operation and effect of the present invention will be described hereinafter with reference to FIG. 8 through FIG. 17.

When a user presses an automatic cooking key on keyboard 17. In a state that food to be cooked is positioned on the glass tray 10 within the heating chamber 11, the data which have been inputted to the microcomputer 1 from the keyboard 17 are stored in the data RAM 1*c*, and as the cooling fan motor 4 is actuated in response to the program of the program ROM 1*d* the cooling fan 5 rotates. And, the weight signal which has been outputted from the weight sensing circuit 15 and converted into a digital signal by the analog/digital converter 1*a*, is inputted to the fuzzy controller 1*b* and then stored in the data RAM 1*c*.

That is, when food to be cooked is positioned on the glass tray 10 within the heating chamber 11, the weight of food is detected at the weight sensor 8 so that the voltage inducer 15*a* of the weight sensing circuit 15 moves upwardly and downwardly, thereby alternating voltages opposite to each other are induced at the secondary windings T12 and T13 of the transformer T1. These alternating voltages are rectified, respectively, at the bridge diodes BD1 and BD2 and the output voltage difference of the bridge diodes BD1 and BD2 is detected at the voltage detector 8*b*, which is constituted with variable resistors VR1 and VR2, a capacitor C1 and a resistor R1, and then outputted through an output terminal Vout. The variable resistor VR1 is adapted to control the voltage which is applied to the analog/digital converter 1*a* to be a zero voltage, and the variable resistor VR2 is adapted to control the output voltage of the transformer T1 to be linear. The direct current voltage which is output through the output terminal Vout of the voltage detector 8*b* is converted into a digital signal by the analog/digital converter 1*a* and then applied to the fuzzy controller 1*b*, and the fuzzy controller 1*b* stores the weight signal which is outputted from the analog/digital converter 1*a* to the data RAM 1*c*.

Figure 8:
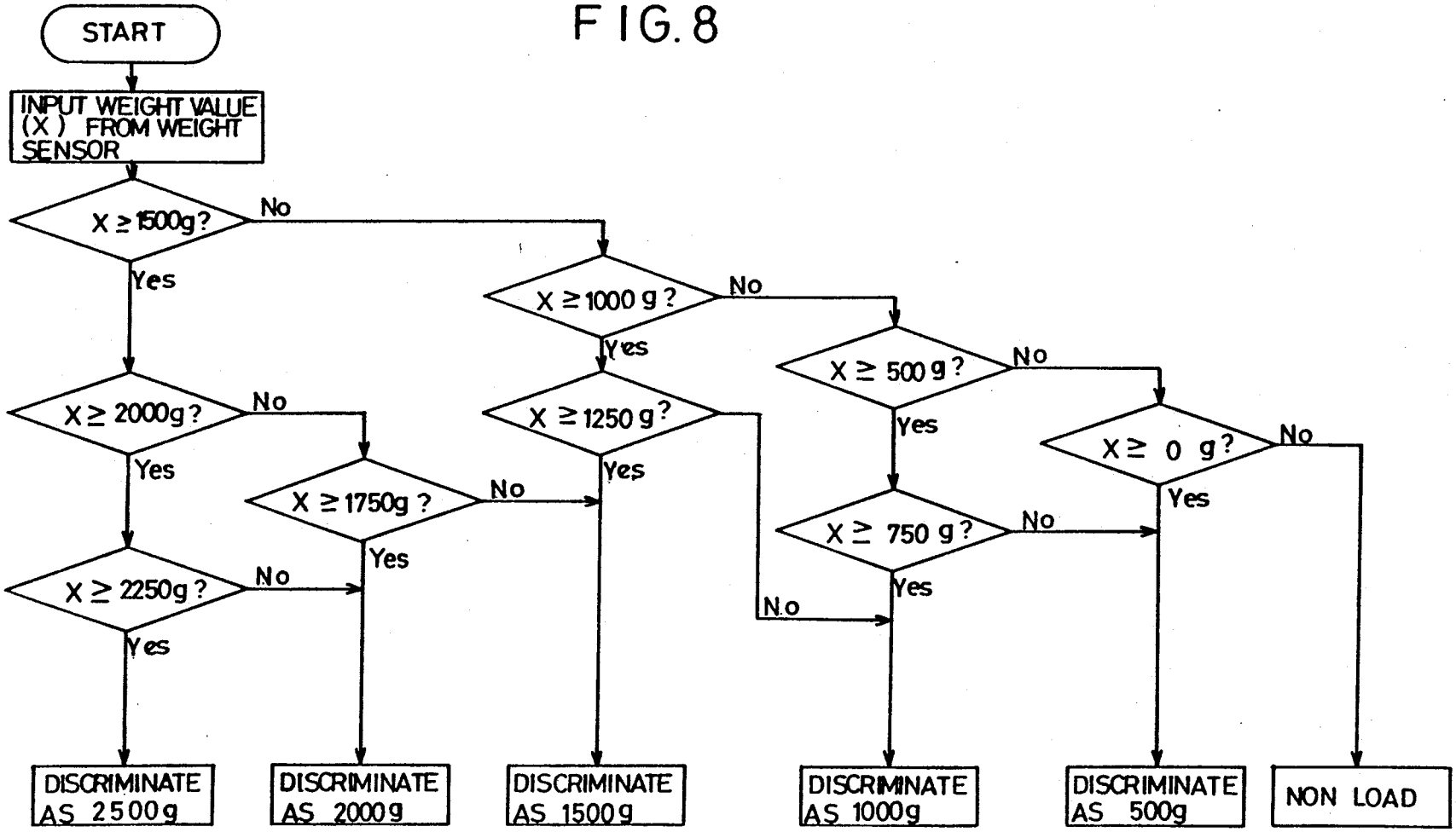
FIG. 8 is a flowchart of a weight recognition according to the present invention.

At this moment, the microcomputer 1 recognizes the weight of food as follows. As shown in FIG. 8, when an arbitrary weight sensing value X is inputted, the weight sensing value X is compared with an example value of 1500 g and in case that the weight sensing value X is equal to or greater than the example value of 1500 g, the weight sensing value X is compared with another example value of 2000 g. If the weight sensing value X exceeds 2000 g, it is compared again with a further value of 2250 g and if it is equal to or than the value of 2250 g, the weight sensing value X is determined as 2500 g. Such a maximum value of weight recognition is established by the cooking capacity of the microwave oven, but in the present invention the maximum value is assumed to be 2500 g. Thus, in case that the weight sensing value X exceeds 2500 g, it is determined as an overload state so that an error signal is indicated.

When the weight sensing value X is equal to or greater than the value of 2000 g and smaller than the value of 2250 g, the weight sensing value X is discriminated as 2000 g, and in case that the weight sensing value X is less than the value of 2000 g, it is compared with a value of 1750 g, when the weight sensing value X is greater than the value of 1750 g, the weight sensing value X is discriminated as 2000 g and in case that it is less than the value of 1750 g, it is discriminated as 1500 g.

In the same manner, the weight sensing value is compared in order with values of 1000 g, 1250 g, 500 g, 750 g and 0 g and when it is less than 0 grams, it is discriminated as a non-load state and an error is indicated.

Accordingly, in the present invention the weight sensing value is recognized in the unit of 500 g, that is, the weight sensing value from 1 g to 749 g is recognized as 500 g, 750 g to 1249 g as 1000 g, 1250 g to 1749 g as 1500 g, 1750 g to 2250 g as 2000 g, and 2250 g to 2500 g as 2500 g.

In the program ROM 1*d* of the microcomputer 1, programs corresponding to types of cooking and weights of food are stored and the fuzzy controller 1*b* designates corresponding address of the program ROM 1*d* in accordance with the weight value and the designated type of food which are recognized in the above manner, and substitutes an additional value corresponding to the kind of cooking for a mathematical constant (a), thereafter calculating a cooking time (te), i.e., te=-(a.b)/10 by substituting the weight value which has been stored in the data RAM 1*c* for a mathematical constant (b).

For example, in case that cooking is selected for rice so that the additional value is 40 and the weight is 400 g, a value of 40 is substituted for the mathematical constant (a) and a value of 400 is substituted for the mathematical constant (b), thereby the cooking time (te) equals to 1600 seconds.

Figure 11:
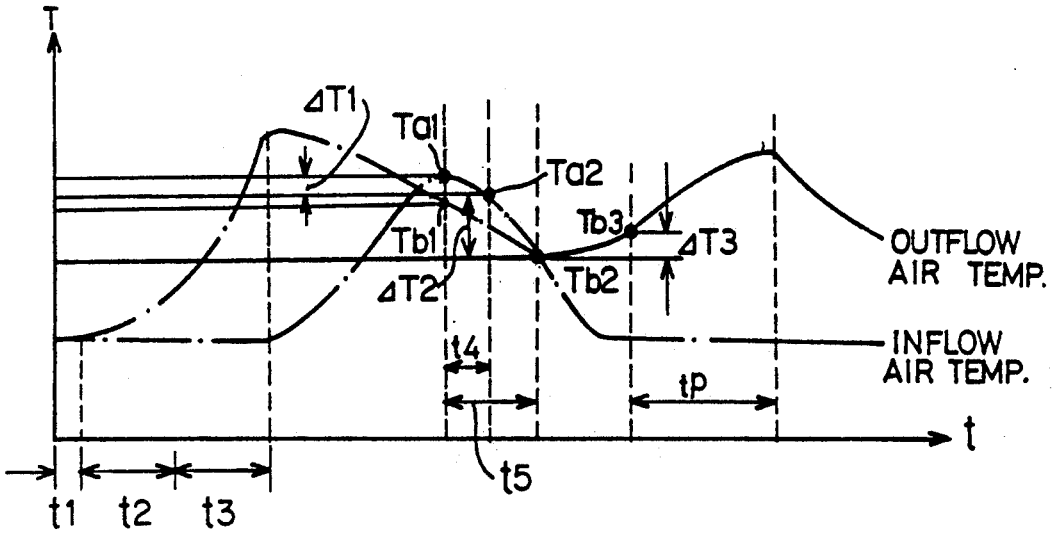
FIG. 11 is a graph of the temperature characteristics in the consecutive operation cooking mode according to the present invention.
Figure 12:
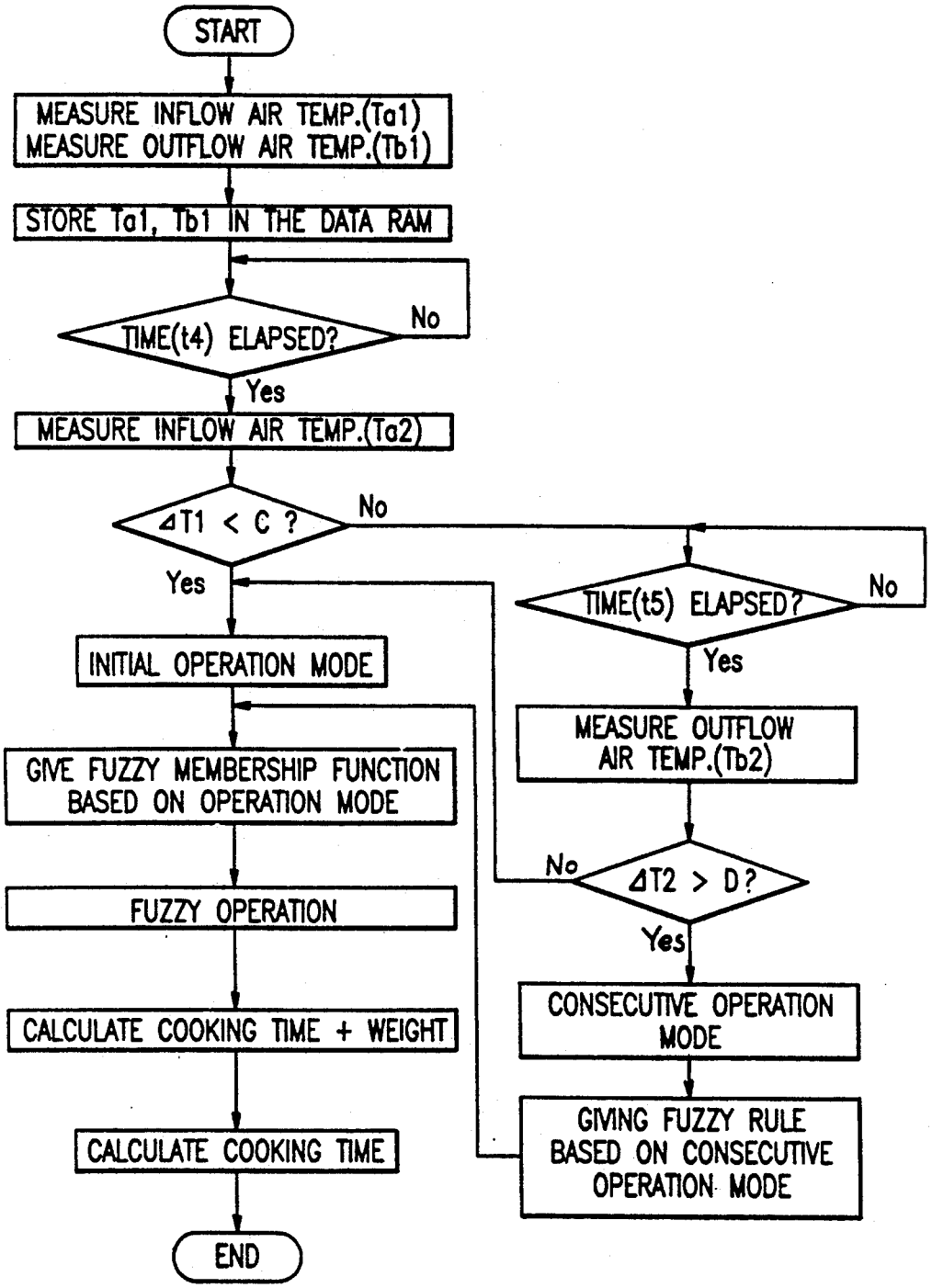
FIG. 12 is a signal flowchart for selecting an operation mode according to the present invention.

The arbitrary cooking time (te) is stored in the data RAM 1*c* and then the cooking mode is discriminated as to whether it is an initial operation mode that no cooking operation has not been carried out previously or a consecutive operation mode that a cooking operation has been carried out previously through the procedure for selecting an operation mode, as shown in FIG. 11.

That is, in an initial stage, the cooling fan motor 4 and the cooling fan 5 are driven upon the control of the fuzzy controller 1*b*, an arbitrary cooking time te is calculated and stored in the data RAM 1*c*, and thereafter outflow air temperature signal and inflow air temperature signal which are outputted from the temperature sensing circuits 16 and 17 are stored in the data RAM 1*c* through the analog/digital converter 10.

At this moment, the resistance of the outflow air temperature sensor 6 varies depending upon the temperature of air which flows out of the air outlet 12 and the voltage outputted from the output terminal Vout1 of the temperature sensing circuit 16 in response to the resistance change of the outflow air temperature sensor 6 is changed. Similarly, the resistance of the inflow air temperature sensor 15 varies in response to the temperature of air which flows in the air inlet 13 and a voltage in response to the resistance change is detacted and outputted from the temperature sensing circuit 17. The outflow air temperature signal and the inflow air temperature signal which are output from the temperature sensing circuit 16 and 17 are converted into a digital signal by the analog/digital converter 1*a* and applied to the fuzzy controller 1*b*, so that an inflow air temperature Ta and an outflow air temperature Tb1 are stored in the data RAM 1*c*.

Thereafter, the fuzzy controller 1*b* checks repeatedly as to whether a predetermined time t4 has elapsed and in case that the time t4 has elapsed, it measures an inflow air temperature Ta2 to find an absolute value ($\Delta T1=|Ta1-Ta2|$) which is a difference value obtained by substracting the inflow are temperature Ta2 from the previous inflow air temperature Ta1. The absolute value $\Delta T1$ is compared with a constant C and in case that the absolute value $\Delta T$ is smaller than the constant C it is discriminated to be an initial operation mode, while in case that the absolute value $\Delta T$ is larger than the constant C, it is verified again as to whether the operation mode is a consecutive mode or not. That is, after a predetermined time t5 has elapsed, the outflow air temperature Tb2 is measured again and an absolute value ($\Delta T2=|Tb1-Tb2|$) which is obtained by subtracting the outflow air temperature Tb2 from the previously measured outflow air temperature Tb1. When the absolute value $\Delta T2$ is larger than a constant D by comparing them, a consecutive operation mode is selected, while in case of smaller than the constant D an initial operation mode is selected.

Such an operation mode selection is based on the following.

Figure 10:
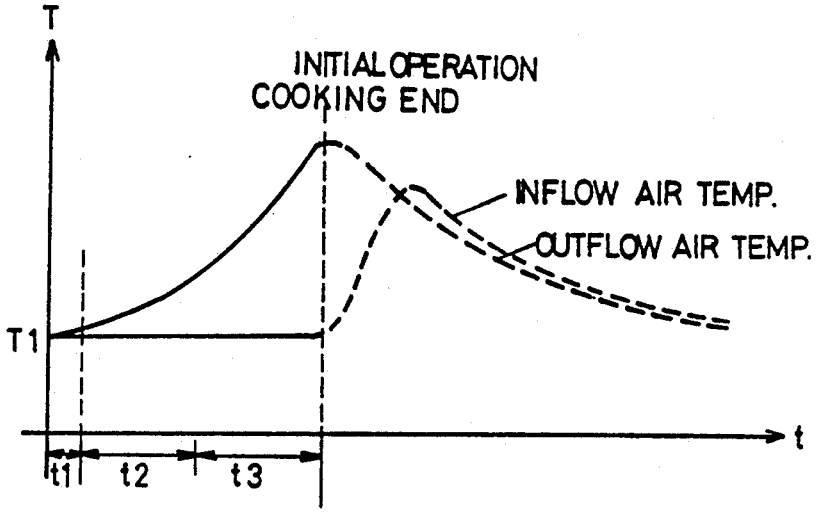
FIG. 10 is a graph of the temperature characteristics in the initial operation cooking mode according to the present invention.

In case of an intial cooking operation, since there is no variation of inflow air temperature as shown in FIG. 10, the operation mode is discriminated as an initial operation mode when an absolute value $\Delta T1$ of the inflow air temperature difference is smaller than a constant C. While in case of a consecutive operation mode that a cooking operation has been carried out before, it is primarily discriminated that the operation mode is not an initial operation mode when the absolute value $\Delta T1$ of the inflow air temperature difference is over the constant C, as shown in FIG. 11, and thereafter when an absolute value $\Delta T2$ of the outflow air temperature is more than a constant D, it is definitely discriminated that the operation mode is a consecutive cooking operation mode. If the operation mode is discriminated not to be a consecutive operation mode, the operation mode is regarded as an initial operation mode.

Once the operation mode is discriminated as a consecutive operation mode, a fuzzy rule is given for the consecutive operation mode, thereafter a fuzzy membership function for the operation mode is given and then a cooling operation is carried out after calculating a cooking time by a fuzzy operation.

Figure 13:
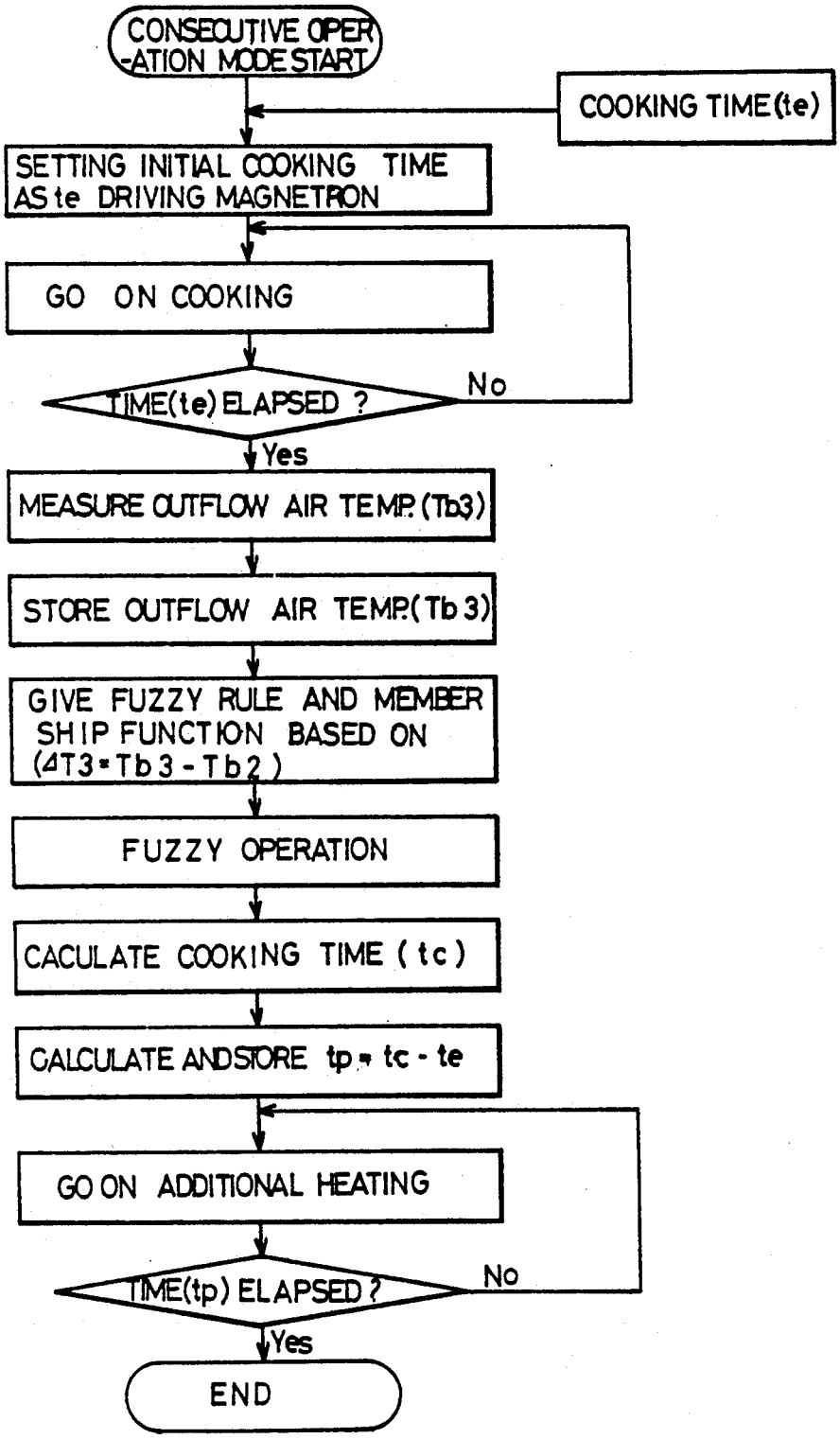
FIG. 13 is a signal flowchart in accordance with the selection of a consecutive operation cooking mode according to the present invention.

Such an operation will now be described in detail with reference to FIG. 13.

First, the fuzzy controller 1*b* of the microcomputer 1 reads out an arbitrary cooking time te which is stored in the data RAM 1*c* and selects an initial cooking time and then outputs a magnetron driving control signal. By the magnetron driving signal, the translator TR1 of the magnetron driving section 2 becomes conductive so that the relay RL1 is driven and the switch SW1 is short-circuited. As a result, an alternating current source AC is applied to a primary winding of the transformer T2 so that a high voltage is induced to a secondary winding of the transformer T2. This high voltage is rectified at the high voltage rectifier 2*b* and actuates the magnetron 3.

Upon driving the magnetron 3, the food within the heating chamber 11 is heated and an outflow air temperature of the air outlet 12 becomes high. When the cooking time reaches a preestablished cooking time te, the fuzzy controller 1*c* receives and stores an outflow air temperature Tb3, which is outputted from the temperature sensing circuit 16 and passes through the analog/digital converter 1*b*, to the data RAM 1*c*, calculates an outflow air temperature difference ($\Delta T3 = Tb3 - Tb2$) by subtracting a previously measured outflow air temperature Tb2 from the currently measured outflow air temperature Tb3, gives a fuzzy membership function and rule in response to the outflow air temperature difference $\Delta T3$ and a weight conversion value of food which is stored in the data RAM 1*c*, and calculates a cooking time to by executing a fuzzy operation, as shown in FIG. 14 to FIG. 17.

Thereafter, an additional heating time tp, i.e., a value obtained by subtracting the preestablished arbitrary cooking time te from the calculated cooking time tc, is calculated and stored in the data RAM 1*c* and an additional heating is continuously executed.

Thereafter, the fuzzy controller 1*b* of the microcomputer 1 checks whether the additional heating time tp has elapsed and when the additional heating time tp has not been elapsed, it proceeds with the additional heating and when the additional heating time has been elapsed, it finishes the cooking operation by ceasing the driving of the magnetron 3 and the cooling fan 5.

On the other hand, when the operation mode is selected as an initial operation mode, an outflow air temperature difference $\Delta T2$, i.e., $\Delta T2 = Tb2 - Tb1$, is calculated by subtracting the outflow air temperature Tb1 from the currently measured outflow air temperature Tb2, thereafter a fuzzy membership function is given in response to the outflow air temperature difference $\Delta T2$ and the weight conversion value of food which is stored in the data RAM 1*c* and a cooking time tc is calculated by executing a fuzzy operation. Thereafter, an additional cooking time tp is calculated and the cooking operation is executed, as in the above-mentioned consecutive operation mode.

Referring to FIG. 14A which shows a fuzzy rule table for an initial operation mode and FIG. 14B which shows a fuzzy rule table for a consecutive operation mode, the fuzzy rule is constituted such a manner that the weight is classified into three types of values, i.e., a positive small value (PS), a positive middle value (PM), and a positive big value (PB), and the outflow air temperature difference $\Delta T$ is classified into three types of values, i.e., a positive small value (PS), a positive middle value (PM), and a positive large value (PL).

In the table, fuzzy rule "1" means that a cooking time tc is positive small1 (PS1) in case that the weight is PS and the outflow air temperature difference is PS. That is, since that the weight of food is light and the outflow air temperature difference ($\Delta T3 = Tb3 - TB2$) is small means that the heating of food is nearly completed so that the cooking operation is finished, the cooking time tc is set as a small value (PS1).

In addition, fuzzy rule "2" corresponds to a case that the weight is small (PS) and the outflow air temperature difference ($\Delta T3 = Tb3 - Tb2$) is a middle value (PM). This means that the outflow air temperature difference $\Delta T3$ becomes larger than the fuzzy rule "1", that is, the microwave oven is heated less than the case of fuzzy rule "1" by virtue of a long-term non-operation time. Accordingly, it requires a longer heating time than the case of fuzzy rule "1" in order to execute a precise cooking operation.

In result, the increase of weight means an extension of cooking time and the increase of outflow air temperature difference also means an extension of cooking time in establishing the cooking time tc.

Accordingly, fuzzy rule "3" is a rule that the cooking time tc is set as a middle value (PM1) in case that the weight is a small value (PS) and the outflow air temperature difference is a large value (PL), fuzzy rule "4" is a rule that the cooking time tc is set as PS1 in case that the weight is a middle value (PM) and the outflow air temperature difference is a small value (PS), fuzzy rule "5" is a rule that the cooking time to is set as PM1 in case that the weight is a middle value (PM) and the outflow air temperature difference is a middle value (PM), fuzzy rule "6" is a rule that the cooking time tc is set as PM2 in case that the weight is a middle value (PM) and the outflow air temperature difference is a large value (PL), fuzzy rule "7" is a rule that the cooking time tc is set as P82 in case that the weight is a big value (PB) and the outflow air temperature difference is a small value PS, fuzzy rule "8" is a rule that the cooking temperature to is set as PM2 in case that the weight is a big value (PB) and the outflow air temperature difference is a middle value (PM), and fuzzy rule "8" is a rule that the cooking temperature tc is set as PL1 in case that the weight is a big value (PB) and the outflow air temperature difference is a large value (PL).

The contents of the respective fuzzy rules are established by experimental data.

Figure 15:
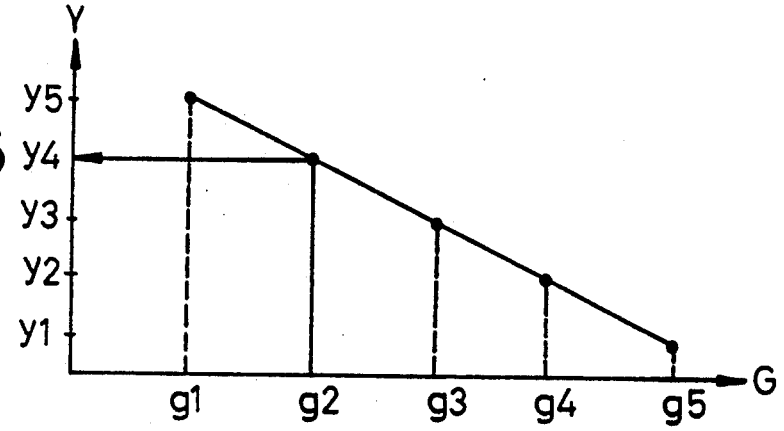
Figure 15:
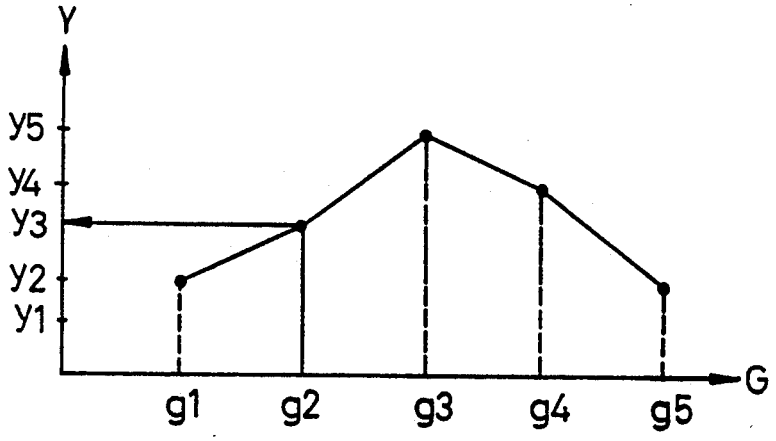
Figure 15:
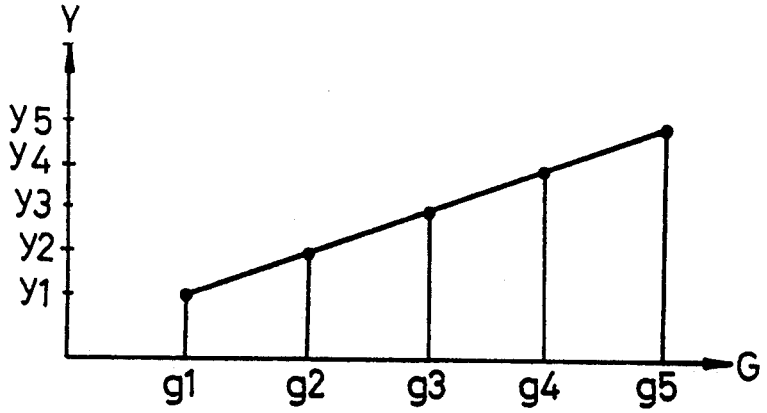

FIG. 15 is a graph for giving a fuzzy membership function for the weight, in which the weight G is divided into five regions, i.e., g1=100 g, g2=500 g, g3=1,000 g, g4=1,500 g, and g5=2,000 g and additional values y are given with respect to the five regions according to the weight being a small value (PS), a middle value (PM) and a big value (PB). That is, the region of the additional value y is divided into five regions i.e., y1=0.2, y2=0.4, y3=0.6, y4=0.8, y5=1 and the additional values y1-y5 are given with respect to the regions g1-g5 of the weight G.

For example, in case that the weight is a small value (PS), an additional value "1" is given which is a largest additional value y5 to the lightest weight region g1, and an additional value "0.2" is given which is a smallest additional value y1 to the heaviest weight region g5.

That is, the additional values y5=1, y4=0.8, y3=0.6, y2=0.4, y1=0.2 are given with respect to the regions g1, g2, g3, g4, g5 of the weight y, respectively, so as to be proportional thereto.

In case that the weight is a middle value (PM), an additional value "1" which is a largest additional value y5 is given to the middle weight region g3, as shown in FIG. 15B, and with respect to other weight regions g4, g2, g5, g1, additional values y4=0.8, y3=0.6, y2=0.4, y1=0.2 are given, respectively.

In case that the weight is a big value (PB), additional values y1=0.2, y2=0.4, y3=0.6, y4=0.8, y5=1 are given to the weight regions g1, g2, g3, g4, g5 respectively, so as to be proportional thereto, as shown in FIG. 15C.

Figure 16:
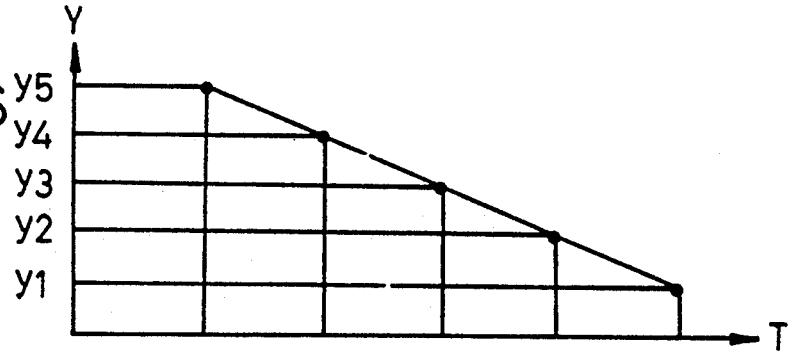
Figure 16:
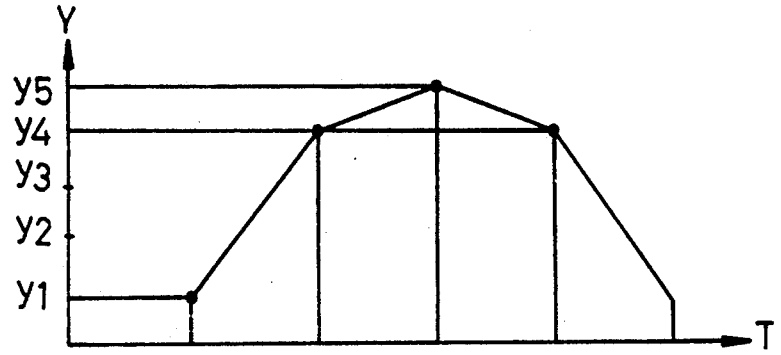
Figure 16:
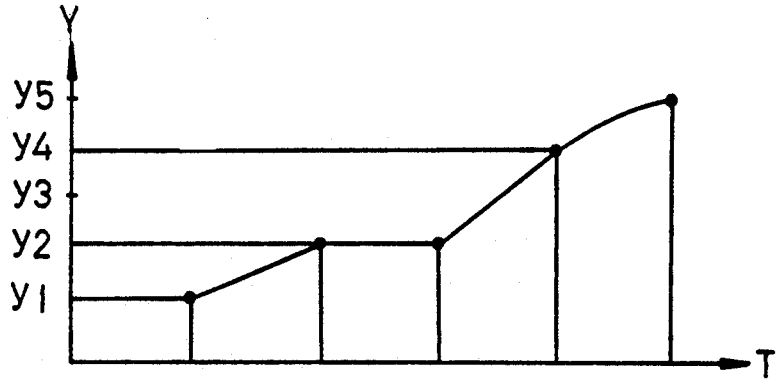
Figure 17:
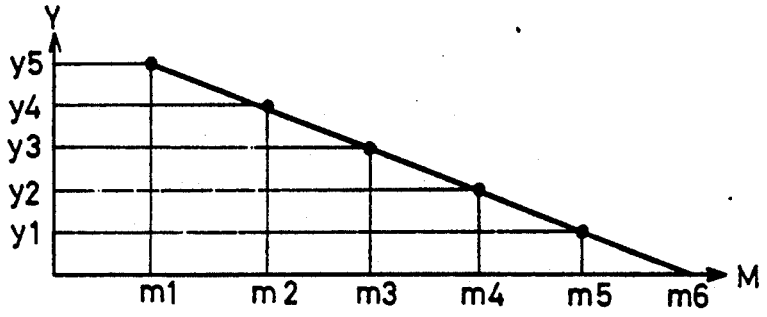
Figure 17:
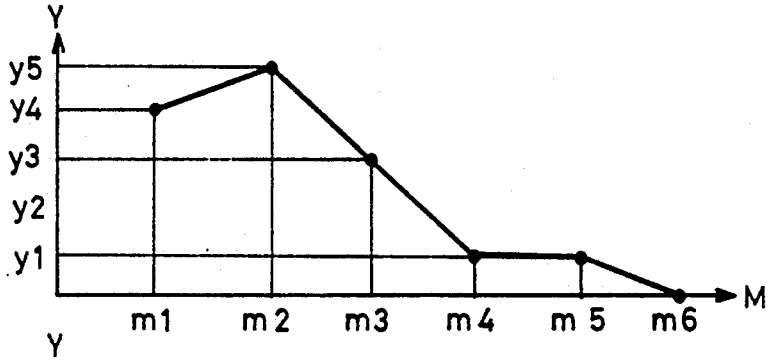
Figure 17:
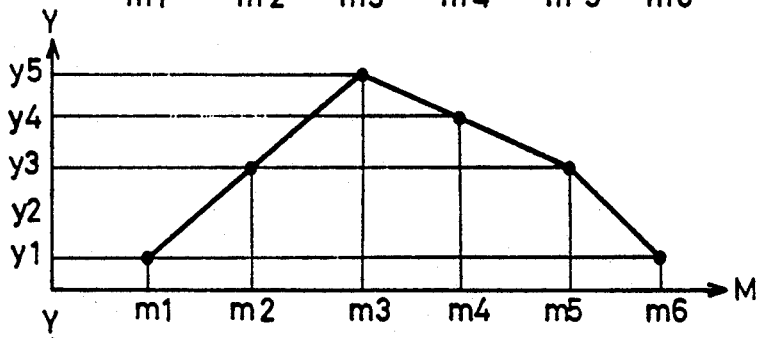
Figure 17:
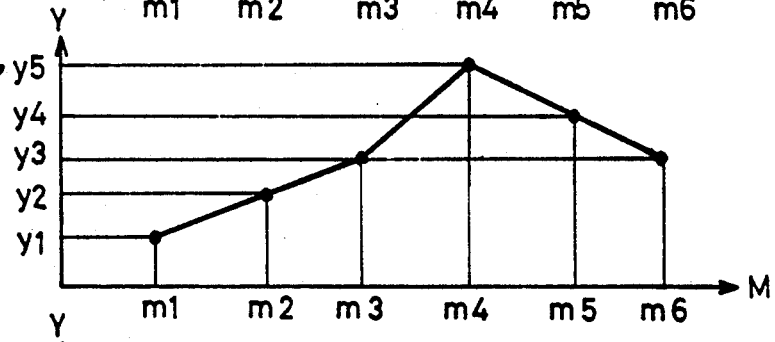
Figure 17:
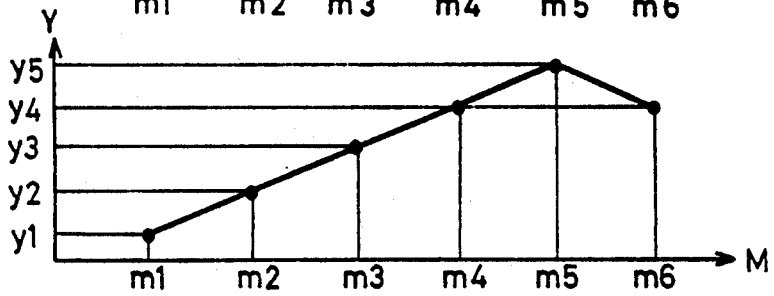

FIG. 16 is a graph for giving a membership function for the outflow air temperature difference ΔT3, in which additional values y are given according as the outflow air temperature difference ΔT3 is a small value (PS), a middle value (PM), a large value (PL), as shown in FIGS. 16A, 16B and 16C in the same manner as in FIG. 15. And, the regions T1, T2, T3, T4, T5 of the outflow air temperature difference ΔT3 are divided into 1° C., 5° C., 10° C., 15° C., 20° C., respectively.

FIGS. 17A to 17E are graphs for giving the additional values according as the cooking time tc is small values PS1 and PS2, middle values PM1 and PM2, and large values PL1 and PL2, in which the cooking time tc is divided into six regions, m1=90 minutes, m2=10 minutes, m3=30 minutes, m4=60 minutes, m5=90 minutes, and m6=120 minutes, The cooking time tc can be calculated by use of a fuzzy direct method and a fuzzy central method by virtue of the fuzzy rules "1" to "9" and the fuzzy membership function giving procedure as mentioned above.

For example, when a cooking time tc is calculated through a fuzzy operation in case that the weight is 500 g (g2) and the outflow air temperature difference (ΔT3=Tb3−Tb2) is 10° C. (T3), the additional value y4 becomes 0.8 under the condition that the weight is PS in accordance with the fuzzy rule "1" and the additional value y3 becomes 0.6 under the condition that the outflow air temperature difference is PS so that a small value (indicated as "Λ") between the additional values y4=0.8 and y3=0.6 is selected as an additional value W1. That is, the additional value in accordance with the fuzzy rule "1" becomes as W1=Y4Λy3=0.8Λ0.6=0.6=y3. In the same manner, an additional value W2 in accordance with the fuzzy rule "2" becomes as W2=y4(0.8)Λy5(1)=y4(0.8), an additional value W3 in accordance with the fuzzy rule "3" becomes as W3=y4(0.8)Λy2(0.4)=y2(0.4), W4=y3(0.6)Λy3(0.6)=y3(0.6), W5=y3(0.6)Λy5(1)=Y3(0.6), W6=y3(0.6)Λy2(0.4)=y2(0.4), W7=y2(0.4)Λy3(0.6)=y2(0.4), W8=y2(0.4)Λy5(1)=y2(0.4), W9=y2(0.4)Λy2(0.4)=y2(0.4).

When the additional values W1 to W9 for the fuzzy rules "1" to "9" are determined, a fuzzy operation is executed. That is, in case that the cooking time tc is short, i.e., a small value (PS1), it corresponds to the fuzzy rules "1" and "4" among the fuzzy rules "1" to "9", as shown in FIG. 13B, a large value (indicated as "V") is selected between the additional value y3(0.6) which is a value in case of fuzzy rule "1" and the additional value y3(0.6) which is a value in case of fuzzy rule "4" and then the selected value is established as an additional value Wa in case that the cooking time tc is PS1.

In the same manner, in case that the cooking time tc is PS2, the additional value is calculated as Wb=W2VW7=y4(0.8)Vy2(0.4)=y4(0.8), in case that the cooking time tc is PM1, the additional value is calculated as Wo=W3 W5=y2(0.4)Vy3(0.6)=y3(0.6), in case of to=PM2, the additional value Wd=WoVW8=Y2(0.4)Vy2(0.4)=y2(0.4), and in case of tc=PL1, the additional value We=W9=Y2(0.4).

In case that the additional value Wa and the cooking time tc which are obtained as above are PS1, an operation for selecting a minimum value (indicated as "Λ") is executed among the additional values corresponding to respective times, m1=1 minute, m2=10 minutes, m3=30 minutes, m4=60 minutes, m5=90 minutes, and m6=120 minutes.

That is, in case that the cooking time tc is PS1, as shown in FIG. 17A, an additional value y5(1) is given to the cooking time m1(1 minute), so that a minimum value y3(0.6) is selected between the additional values Wa, y3(0.6) and y5(1), which have been calculated above.

Again, since the additional value for m2(10 minutes) is y4(0.8), a minimum value y3(0.6) is selected between the additional values Wa, y3(0.6) and y4(0.8), and in the same manner, y3(0.6) for the cooking time m3(30 minutes), y2(0.4) for the cooking time m4(60 minutes), y1(0.2) for the cooking time m5(90 minutes), and "0" for the cooking time m6(120 minutes).

That is, in case that the cooking time tc is PS1, the additional value Wa and the cooking time tc have the relationship of WaΛtc=y3Λy5/m1+y3Λy4/m2+y3Λy3/m3+y3Λy2/m4+y3Λy1/m5+y3Λ0/m6, in case that the cooking time tc is PS2, the additional value Wb and the cooking time to have the relationship of WbΛtc=y4Λy4/m1+y4Λy5/m2+y4Λy3/m3+y4Λy1/m4+y4Λy1/m5+y4Λ0/m6, in case of the cooking time tc=PM1, WcΛtc=y3Λy1/m1+y3Λy3/m2+y3Λy5/m3+y3Λy4/m4+y3Λy3/m5+y3Λy1/m6, in case of the cooking time tc=PM2, WdΛtc=y2Λy1/m1+y2Λy2/m2+y2Λy3/m3+y2Λy5/m4+y2Λy4/m5+y2Λy3/m6, and in case of tc=PL1, WeΛtc=y2Λy1/m1+y2Λy2/m2+y2Λy3/m3+y2Λy4/m4+y2Λy5/m5+y2Λy4/m6.

When the operations are completed with respect to the additional values Wa to Ws, each operation has additional values for all of the time units (cooking time units: m1=1 minute, m2=10 minutes, m3=30 minutes, m4=60 minutes, m5=90 minutes, m5=120 minutes), and thus operations are executed by time unit with respect to the additional values.

That is, as for the additional value for the case that the cooking time tc is m1(1 minute), the additional value is y3(0.6) in case of Wa Λ, y4(0.8) for WbΛtc(PS2), y1(0.2) for WcΛtc(PM1), y1(0.2) for WdΛtc(PM2), and y1(0.2) for WsΛtc(PL1), and thus a maximum value y4(0.8) (indicated as "V") is selected among the above five values.

In the same manner, in case that the cooking time tc is m2(10 minutes), since the additional value is y3(0.5) in case of WaΛtc(PS1), y4(0.8) for WbΛtc(PS2), y3(0.6) for WcΛtc(PM1), y2(0.4) for Wd Λtc(PM2), and y2(0.4) for WsΛtc(PL1), a maximum value y4(0.8) is selected among the five values. Similarly, in case that the cooking time tc is m3(30 minutes), the additional value is selected as y3(0.6), y3(0.6) for m4(60 minutes), y3(0.6) for m5(90 minutes), and y2(0.4) for m6(120 minutes).

The additional values obtained as above are multiplied by the times, respectively, and the multiplied values are added together. The added value is divided by an added value of the additional values so that the cooking time tc is calculated. That is, since the additional value is y4(0.8) when the cooking time tc is m1, 0.8 is multiplied by 1 minute, and in the same manner the additional values in case that the cooking times tc are m2–m6 are multiplied by respective times as in the following equation.

$$tc = \frac{0.8 \times 1 + 0.8 \times 10 + 0.6 \times 30 + 0.6 \times 60 + 0.6 \times 90 + 0.4 \times 120}{0.8 + 0.8 + 0.6 + 0.6 + 0.6 + 0.4} = 43.36$$

The above value, 43.36 minutes are cooking time tc for carrying out the cooking operation in case that the weight is 500 g and the outflow air temperature difference ($\Delta T3 = Tb3 - Tb2$) is 10° C.

Such an operation for calculating the cooking time tc is executed by the fuzzy controller 1*b* of the microcomputer 1, while the cooking time tc may also be calculated by outside means from the weight of each food to be cooked and the respective temperature difference $\Delta T3$ and the calculation result may be stored in the program ROM 1*d* of the microcomputer 1.

As described above in detail, the present invention provides the effect that it is capable of executing optimally a cooking operation irrespective of the operation mode such as an initial operation mode or a consecutive operation mode since the automatic cooking is carried out by calculating the cooking time in precise by virtue of a fuzzy operation using an inflow air temperature signal, an outflow air temperature signal and a weight sensing signal. The present invention also provides a user with convenience in use since it is capable of executing a next cooking operation even in case that a previous cooking operation has been executed immediately before.

The invention being thus described, it will be obvious that the same may be varied in many ways. Such variations are not to be regarded as a departure from the spirit and scope of the invention, and all such modifications would be obvious to one skilled in the art are intended to be included in the scope of the following claims.

What is claimed is:

1. An apparatus for automatic cooking in a microwave oven, comprising:

means for sensing an outflow air temperature of a heating chamber;

means for sensing an inflow air temperature of the heating chamber;

outflow air temperature and inflow air temperature sensing circuits for converting the temperatures sensed by said outflow and inflow air temperature sensing means into outflow air and inflow air signals, respectively;

wherein said outflow and inflow air temperature sensing means output a voltage in proportion to a variation of their resistance in response to a temperature change;

weight sensing means for sensing a weight of food positioned within the heating chamber and converting the sensed weight into a weight signal including, a weight sensing section for sensing the weight of food positioned within the heating chamber, and a weight sensing circuit for converting the sensed weight by the weight sensing section into the weight signal, said weight sensing circuit including, a transformer for receiving an alternating current source and inducing an alternating current to a first and a second secondary windings, inducing means for changing a voltage induced at the first and second secondary windings by moving between a primary winding and the secondary windings of the transformer in response to an output signal from the weight sensing section, first and second rectifying means for rectifying the voltages induced at the first and second secondary windings, respectively, and a voltage detection section for detecting an output voltage difference on the first rectifying means and the second rectifying means in response to a movement of the inducing means and outputting the weight signal;

mode determining means for determining whether said apparatus is in an initial operation mode or a consecutive operation mode based on the outflow air signal and the inflow air signal and for generating a mode control signal;

means for driving a magnetron for a predetermined initial heating time in response to the mode control signal; and additional heating time determining means for determining an additional heating time based on the outflow air signal, the weight signal and the mode control signal, and for generating an additional heating signal, said additional heating time determining means including, memory means for storing the outflow air signal, the weight signal, and the mode control signal, a program ROM for executing a predesignated program, and control means for retrieving the outflow air signal, the weight signal, and the mode control signal from said memory means, and executing a fuzzy operation in response to the predesignated program to calculate the additional cooking time;

said magnetron driving means including, a switching section for controlling an input of the alternating current source by being turned on or off by a control signal from the control means, a transformer for boosting the alternating current source to a high voltage in response to the switching section, and a high voltage rectifying section for rectifying a high voltage outputted from the transformer and supplying the rectified high voltage as a driving voltage for the magnetron;

wherein said magnetron driving means drives the magnetron for a predetermined additional heating time in response to the additional heating signal.

2. A method for automatic cooking in a microwave oven, comprising the steps of:

(a) sensing a weight of food positioned within a heating chamber, outflow air temperature and inflow air temperature of the heating chamber, calculating a weight value, and determining whether a cooking mode of the microwave oven is an initial operation mode or a consecutive operation mode;

(b) calculating a fuzzy rule and a fuzzy membership function based on the cooking mode determined in step (a) and executing a cooking operation for a predetermined time based on the fuzzy rule and the fuzzy membership function; and (c) heating for an additional heating time after step (b) is completed and terminating the cooking operation after the additional heating time has elapsed.

3. The method of claim 2, wherein said step (a) includes the sub-steps of:

(a) (1) sensing the weight of food positioned within the heating chamber, (a) (2) converting the weight sensed into digital weight data, and storing the digital weight data in a memory;

(a) (3) calculating an arbitrary initial heating time from the digital weight data stored in the memory and an additional value, corresponding to a type of food to be cooked;

(a) (4) storing the inflow air temperature and the outflow air temperature of the heating chamber in memory after converting the measured temperatures into digital temperature data;

(a) (5) measuring an inflow air temperature of the heating chamber again after a predetermined time has elapsed and calculating a first absolute value of a difference between a subsequent inflow air temperature and the previous inflow air temperature; and (a) (6) measuring an outflow air temperature of the heating chamber again after a predetermined time has elapsed when the first absolute value calculated in step (a) (5) is greater than a predetermined constant, calculating a second absolute value of a difference between the subsequent outflow air temperature and the previous outflow air temperature, and selecting the initial operation mode when the second absolute value is less than a predetermined constant and selecting the consecutive operation mode when the absolute value is greater the predetermined constant.

4. The method of claim 3, where said sub-step (a) (1) includes the sub-steps of:

(a) (1) (A) selecting a weight value which best approximates the weight of the food positioned within the heating chamber by first comparing the weight of the food with a first predetermined reference value and then comparing the weight of the food with a next higher step weight when the weight of the food is greater than the first predetermined reference value;

(a) (1) (B) selecting the weight value which best approximates the weight of the food positioned within the heating chamber by first comparing the weight of food with a second predetermined reference value and then comparing the weight of the food with a next lower step weight when the weight of the food is less than the second predetermined reference value; and (a) (1) (C) displaying a predetermined condition of the heating chamber when food is not positioned within the heating chamber or food which is greater than a maximum allowable capacity of the microwave oven is positioned within the heating chamber.

5. The method of claim 2, wherein the cooking mode is the initial operation mode, said step (b) including the sub-steps of:

(b) (1) heating the food positioned with the heating chamber for an arbitrary initial heating time (b) (2) measuring a subsequent outflow air temperature of the heating chamber after sub-step (b) (1) is complete, and calculating an outflow air temperature difference by subtracting a subsequent outflow air temperature from a previous outflow air temperature which is stored in a memory;

(b) (3) calculating a cooking time by executing a fuzzy operation after calculating a fuzzy membership function and a fuzzy membership rule for the initial operation mode based on the outflow air temperature difference and the weight value; and (b) (4) heating the food positioned within the heating chamber for an additional heating time, wherein the additional heating time is calculated by subtracting the arbitrary initial heating time from the calculated cooking time.

6. The method of claim 2, wherein the cooking mode is the initial operation mode, said step (b) including the sub-steps of:

(b) (1) heating the food positioned within the heating chamber for an arbitrary initial heating time by driving a magnetron and a cooling fan;

(b) (2) calculating an outflow air temperature of the heating chamber after the arbitrary initial heating time has elapsed and calculating an outflow air temperature difference by subtracting a subsequent outflow air temperature from a previous outflow air temperature which is stored in a memory;

(b) (3) generating the fuzzy membership function and the fuzzy rule for the initial operation mode based on the outflow air temperature difference and the weight value;

(b) (4) calculating a cooking time by executing a fuzzy operation;

(b) (5) calculating an additional heating time by subtracting the arbitrary initial heating time from the calculated cooking time; and (b) (6) heating the food positioned within the heating chamber for the additional heating time by driving the magnetron and the cooking fan.

7. The method of claim 2, wherein the cooking mode is the consecutive operation mode, said step (b) including the sub-steps of:

(b) (1) heating the food positioned within the heating chamber for an arbitrary initial heating time;

(b) (2) measuring a subsequent outflow air temperature of the heating chamber after sub-step (b) (1) is completed and calculating an outflow air temperature difference by subtracting a previous outflow air temperature stored in a memory from the subsequent outflow air temperature;

(b) (3) calculating a cooking time by executing a fuzzy operation after calculating the fuzzy membership function and the fuzzy rule for the consecutive operation mode based on the outflow air temperature difference and the weight value; and (b) (4) heating the food positioned within the heating chamber for an additional heating time calculated by subtracting the arbitrary initial heating time from the calculated cooking time.

8. The method of claim 7, wherein said step (b) further includes the sub-steps of:

(b) (5) subdividing the outflow air temperature difference into a small outflow value, a middle outflow value and a large outflow value;

(b) (6) subdividing the sensed weight into a small weight value, a middle weight value and a large weight value;

(b) (7) setting the fuzzy rule for the calculated cooking time to a first small fuzzy value (PS1), a second small fuzzy value and a first middle fuzzy value when the outflow air temperature difference is the small outflow value, the middle outflow value and the large outflow value respectively, and when the weight value is the small weight value;

(b) (8) setting the fuzzy rule for the calculated cooking time to the first small fuzzy value, the first middle fuzzy value and a second middle fuzzy value when the outflow air temperature is the small outflow value, the middle outflow value and the large outflow value, respectively and when the weight value is the middle weight value; and (b) (9) setting the fuzzy rule for the calculated cooking time to the second small fuzzy value, the second middle fuzzy value and the large fuzzy value when the outflow air temperature is the small outflow value, the middle outflow value and the large outflow value, respectively, and when the weight value is a large weight value.

9. The method of claim 8, wherein said step (b) further includes the sub-steps of:

(b) (10) calculating additional weight values when the weight value is the small weight value, the middle weight value and the large weight value;

(b) (11) calculating additional outflow values when the outflow air temperature difference is the small outflow value, the middle outflow value and the large outflow value;

(b) (12) calculating additional fuzzy values in response to the fuzzy rule by selecting another small weight value among the additional weight values and another small outflow value among the additional outflow values;

(b) (13) calculating still additional fuzzy values by selecting another large fuzzy value among the additional fuzzy values when the calculated cooking time in response to the fuzzy rule is the first small fuzzy value, the second small fuzzy value, the first middle fuzzy value, the second middle fuzzy value and the large fuzzy value;

(b) (14) selecting a value between the still additional fuzzy values calculated in said sub-step (b) (13) and other values corresponding to respective time units of the calculated cooking time; and (b) (15) setting a final cooking time by selecting still another large fuzzy value between the still additional fuzzy values and the other values corresponding to the calculated cooking time on the basis of the time units, multiplying the selected still another large fuzzy value by the respective time units, adding the multiplied values together, and dividing the added value by the added value of the selected additional values.

10. The method of claim 7 or claim 8, wherein the fuzzy membership function for calculating the weight value is generated by dividing the weight of the food positioned within the heating chamber by a predetermined weight unit, dividing the additional value for the obtained value by a predetermined unit, setting the additional value for the weight unit in proportion to the weight unit when the weight value is the small weight value, and setting the additional value for the weight unit in proportion to the weight unit when the weight unit is proportional to the weight unit when the weight value is the middle weight value.

11. The method of claim 7 or 8, wherein the fuzzy membership function for calculating the outflow air temperature is generated by dividing the outflow air temperature difference by a predetermined temperature unit, dividing the additional value for the obtained value by a predetermined unit, setting the additional value in proportion to the outflow air temperature difference when the outflow air temperature difference is the small outflow value, setting the additional value in proportion to the temperature unit up to a middle temperature unit when the outflow air temperature difference is the middle outflow value, setting the additional value in proportion to the temperature unit after the middle temperature unit when the outflow air temperature difference is the middle outflow value, and setting the additional value in proportion to the temperature unit when the outflow air temperature difference is large outflow value.

12. The method of claim 7 or claim 8, wherein the fuzzy membership function for the calculated cooking time is established by dividing the calculated cooking timed by predetermined time units, dividing the additional value for the cooking time by predetermined units, setting the additional values for the time units to the respective predetermined units when the cooking time is the first small fuzzy value, setting the additional values for the time units to the respective predetermined units, when the cooking time is the first middle fuzzy value, setting the additional values for the time units to the respective predetermined units, when the cooking time is the second middle fuzzy value, and setting the additional values for the time units to the respective predetermined units when the cooking time is the first large fuzzy value.

* * * * *